US007588505B2

(12) United States Patent
Hebert et al.

(10) Patent No.: US 7,588,505 B2
(45) Date of Patent: Sep. 15, 2009

(54) GOLF BALL SURFACE TEXTURES

(75) Inventors: Edmund A. Hebert, Fairhaven, MA (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/025,952

(22) Filed: Jan. 3, 2005

(65) Prior Publication Data

US 2006/0148591 A1 Jul. 6, 2006

(51) Int. Cl.
*A63B 37/06* (2006.01)

(52) U.S. Cl. ..... 473/378

(58) Field of Classification Search ..... 473/378, 473/351, 384, 385

See application file for complete search history.

(56) References Cited

U.S. PATENT DOCUMENTS

| | | | | |
|---|---|---|---|---|
| 4,830,378 | A | 5/1989 | Aoyama | 273/232 |
| 6,475,105 | B1 | 11/2002 | Murphy | 473/378 |
| 6,632,150 | B1 * | 10/2003 | Ogg | 473/378 |

* cited by examiner

*Primary Examiner*—Raeann Trimiew
(74) *Attorney, Agent, or Firm*—Hanify & King, P.C.

(57) ABSTRACT

A method for generating a textured surface for a golf ball is disclosed. Preferably, the textured surface of the golf ball substantially minimizes the drag experienced by the golf ball. The method includes generating a guide pattern. The guide pattern is preferably mapped to the surface of the golf ball. A shaped profile may also be generated. The textured surface of the golf ball may be generated based on sweeping the shaped profile along the guide pattern. It may be desirable to add protrusions or entrenchments to the surface of the golf ball to further reduce drag.

20 Claims, 18 Drawing Sheets

FIG. 16
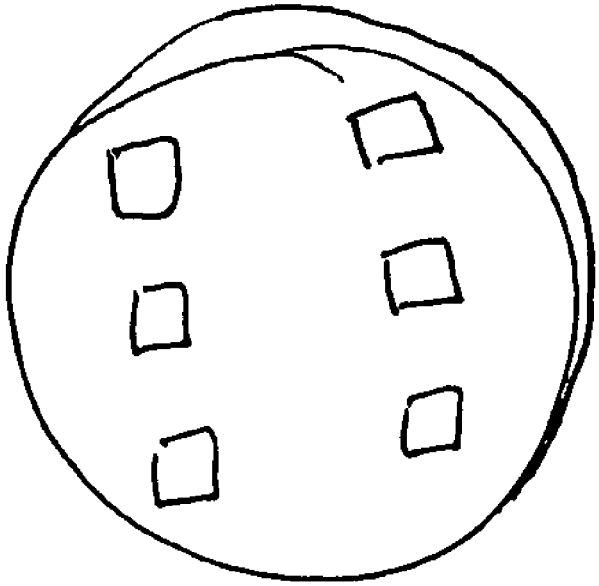
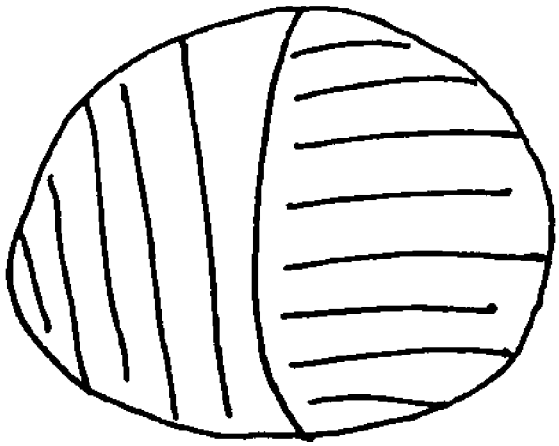
FIG. 17

GOLF BALL SURFACE TEXTURES

FIELD OF THE INVENTION

The present invention relates to golf ball surface textures. More specifically, the present invention relates to forming golf ball surface textures by sweeping shaped profiles along predetermined guide patterns mapped onto the ball's spherical surface.

BACKGROUND OF THE INVENTION

The early golf ball, known as a featherie, consisted of a leather pouch filled with goose feathers. In order to obtain a hard ball, the pouch was usually filled while wet with wet goose feathers. Since it was widely believed that a smooth sphere would result in less drag, and thus fly farther, the pouch was stitched inside out. Once the pouch was filled with feathers, it was stitched shut. In this manner, a golf ball could be constructed with few stitches on the outside of the ball. In many instances, the ball was then dried, oiled, and painted white. The typical drive with this type of ball was about 150 to 175 yards. However, once this ball became wet, it could no longer be used.

Around 1845, the gutta-percha ball was introduced. This ball was made from the gum of the Malaysian Sapodilla tree. Typically, the gum was heated and molded into a sphere, resulting in a very smooth surface. The typical drive with the gutta-percha ball was shorter than that obtained with the featherie. Around this time, many golfers began to notice that older balls that were beat up with nicks, bumps, and other surface irregularities seemed to fly farther. As golf balls evolved, golfers began to seek beat up golf balls because they provided an advantage over smooth balls.

As golf ball research progressed, manufacturers began to realize that including dimples on the surface of the golf ball would allow it to fly farther. The nicks and bumps of previous golf balls, and the dimples of modern golf balls, provide an aerodynamic advantage over a smooth surface. Engineers discovered that the dimples act as "turbulators" in the layer of air next to the ball (the "boundary layer"). In some situations, a turbulent boundary layer is capable of reducing drag, which in turn increases the distance that a golf ball is capable of flying.

The flow of air around an object may be described as laminar and turbulent. Laminar flow has less drag, but it is also susceptible to a phenomenon called "separation." Once separation of a laminar boundary layer occurs, the drag rises dramatically because of eddies that form in the wake. Turbulent flow has more drag initially but also better adhesion, and therefore is less prone to separation. Therefore, engineers learned that if the shape of an object is such that separation occurs easily, it is better to perturb the boundary layer, at the slight cost of increased skin friction drag, in order to increase adhesion and reduce eddies. Typically, this means a significant reduction in drag. Thus, dimples are included on the surface of golf balls in order to perturb the boundary layer. Dimples on a golf ball are a symmetrical way of creating the same turbulence in the boundary layer that nicks and cuts did on previous golf balls.

Golf ball manufacturers are constantly searching for more efficient methods of changing the surface of a golf ball in order to reduce drag and thereby increase the distance that a golf ball is capable of flying.

SUMMARY OF THE INVENTION

According to one aspect of the present invention, the present invention comprises shaped profiles and predetermined guide patterns that may be generated using a processor based computer program or the like. It may be desirable for the processor to be capable of executing computer program instructions. In one embodiment, the processor may be operatively connected to, for example, a memory, user interface, display, and the like. Preferably, the processor is capable of running an operating system that supports a computer program that is capable of simulating the effect of dragging a plurality of different shaped profiles across different paths. It may be desirable for the processor to be capable of determining the drag that would result from different combinations of shaped profiles and guide patterns such that a golf ball manufacturer could use this calculation to choose combinations that result in optimal golf ball surfaces.

In one embodiment, the present invention comprises a method for forming a textured surface for a golf ball. The method includes generating a guide pattern, mapping the guide pattern to the surface of the golf ball, generating a shaped profile, and generating a textured surface for the golf ball based on sweeping the shaped profile along the guide pattern. The guide pattern comprises one of geometric patterns, fractal patterns, lines, and irregular patterns. Alternately, the guide pattern may be randomly defined. The shaped profile may comprise at least one of irregular shapes and regular shapes. In other embodiments, the shaped profile may comprise a smooth and continuous curve.

The guide pattern may be based on about 30 or more mathematical functions. In another embodiment, the guide pattern is based on between about 1 and about 30 mathematical functions. The textured surface may be based on, for example, between about 1 and about 25 guide patterns.

In one embodiment, the shaped profile comprises at least one of a spherical curve, Gaussian curve, Poisson curve, caternary curve, parabolic curve, and hyperbolic curve. Preferably, the shaped profile comprises a portion that is tangent to the spherical surface of the golf ball. According to one aspect of the present invention, more than one shaped profile may be swept along a guide pattern. A guide pattern may comprise a combination of two or more guide patterns. The two or more guide patterns are combined based on at least one of addition, subtraction, multiplication, division, or convolution. Protrusions or entrenchments may be added to the surface of the golf ball as desired.

According to another aspect, the present invention comprises a method for defining a golf ball surface texture. The method includes generating a first guide pattern, mapping the first guide pattern to the surface of the golf ball, generating a first shaped profile, and sweeping the first shaped profile along the first guide pattern to define a first surface texture. The method further comprises generating a second guide pattern, mapping the second guide pattern to the surface of the golf ball, generating a second shaped profile, and sweeping the second shaped profile along the second guide pattern to define a second surface texture.

The present invention is also direct to a method for generating a textured surface for a golf ball that includes generating a plurality of guide patterns, mapping at least one of the plurality of guide patterns to the surface of the golf ball, generating a plurality of shaped profiles, and generating a textured surface for the golf ball based on sweeping at least one of the plurality of shaped profiles along at least one of the plurality of guide patterns.

Preferably, each of the plurality of guide patterns is mapped to a portion of the surface of the golf ball. Preferably, each of the plurality of guide patterns is mapped to less than about 60% of the surface of the golf ball. In another embodiment, each of the plurality of guide patterns is mapped to more than about 80% of the surface of the golf ball. Two or more of the plurality of guide patterns may overlap by a predetermined amount. The amount of overlap may be between about 0% and about 50%. Alternately, the amount of overlap is about 40% or more.

BRIEF DESCRIPTION OF THE DRAWINGS

Further features and advantages of the invention can be ascertained from the following detailed description that is provided in connection with the drawings described below:

FIG. 16 is a diagram showing an exemplary distribution of a guide pattern according to one aspect of the present invention;

FIG. 17 is a diagram showing another exemplary distribution of a guide pattern according to another aspect of the present invention.

DETAILED DESCRIPTION OF THE PREFERRED EMBODIMENTS

Figure 1:
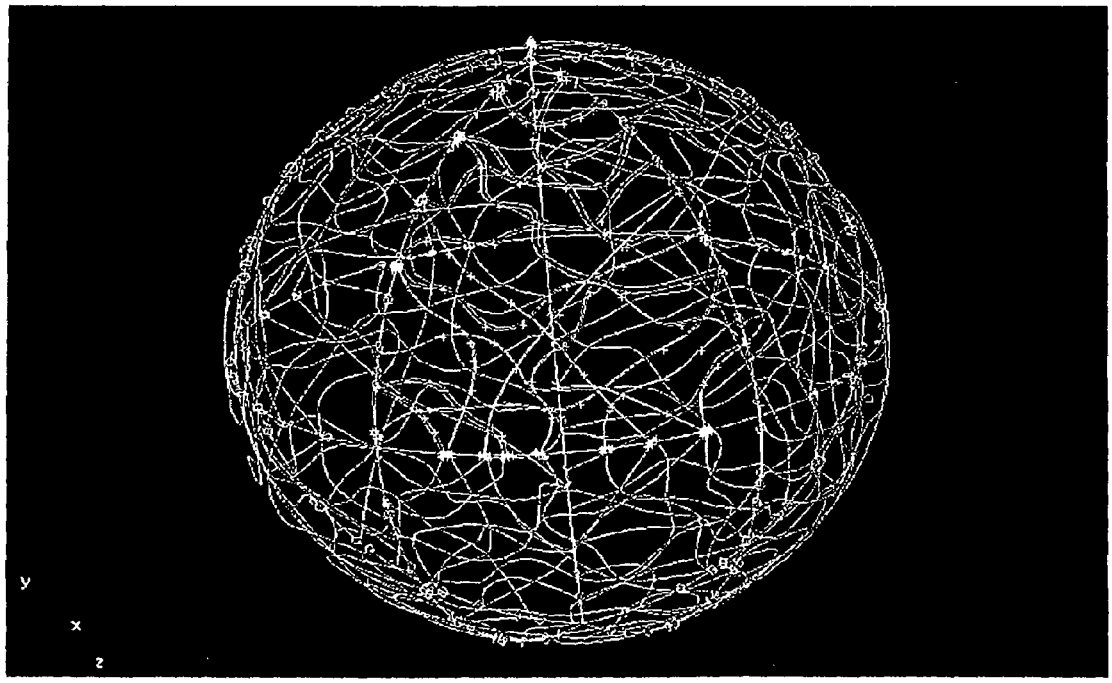
FIGS. 1-14 are diagrams showing exemplary guide patterns according to one aspect of the present invention.
Figure 2:
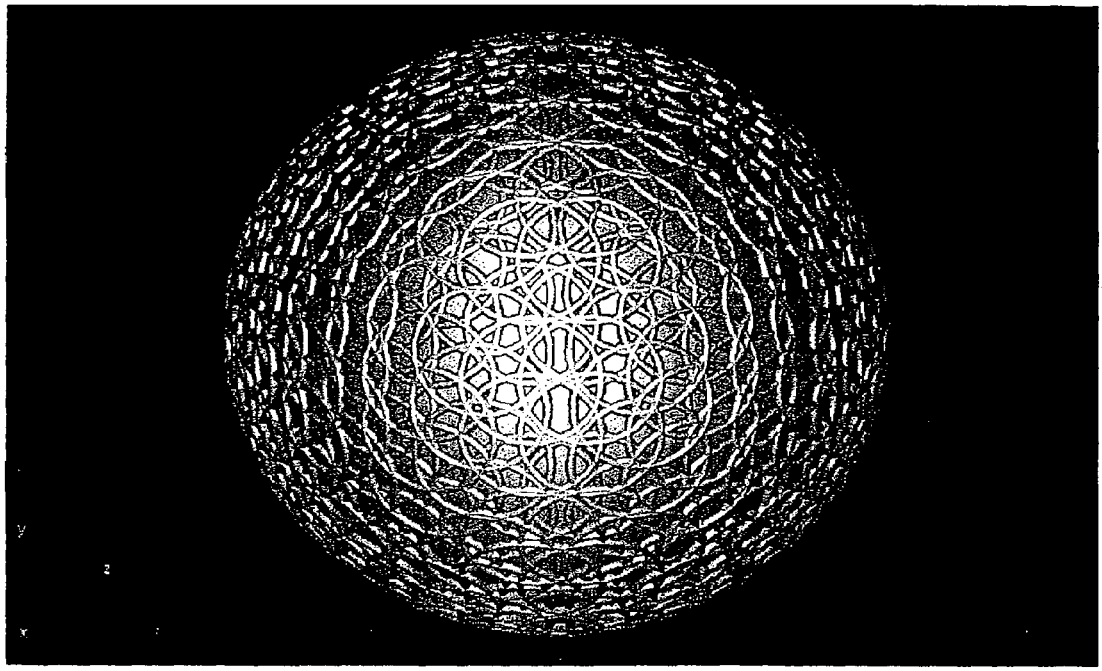
Figure 3:
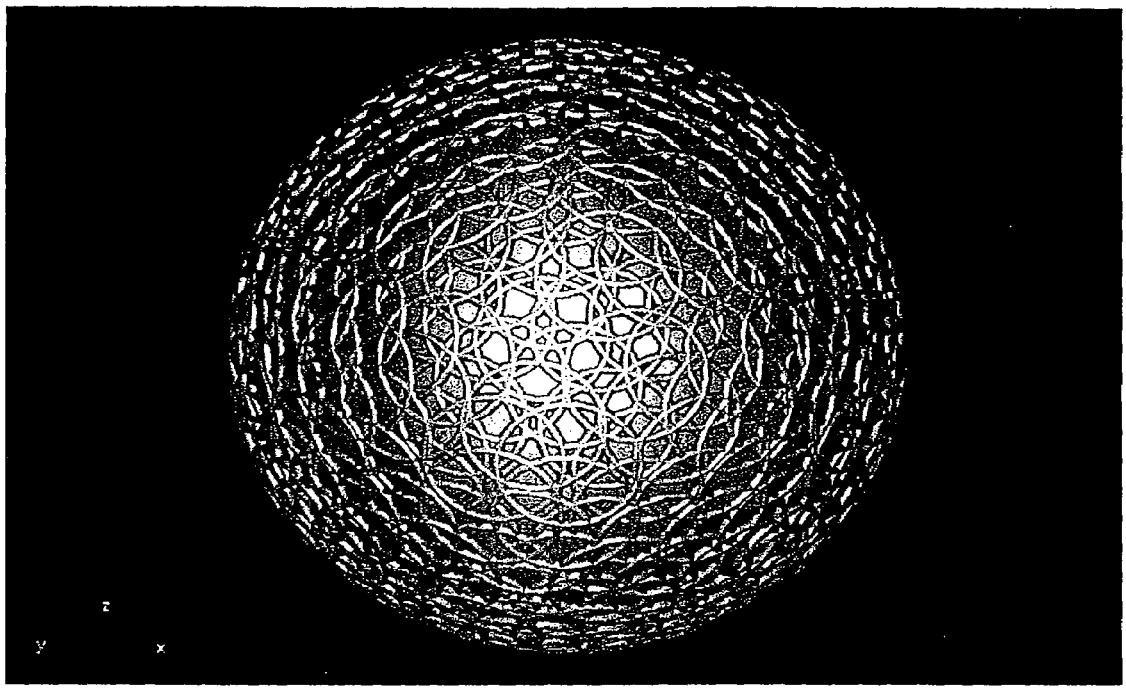
Figure 4:
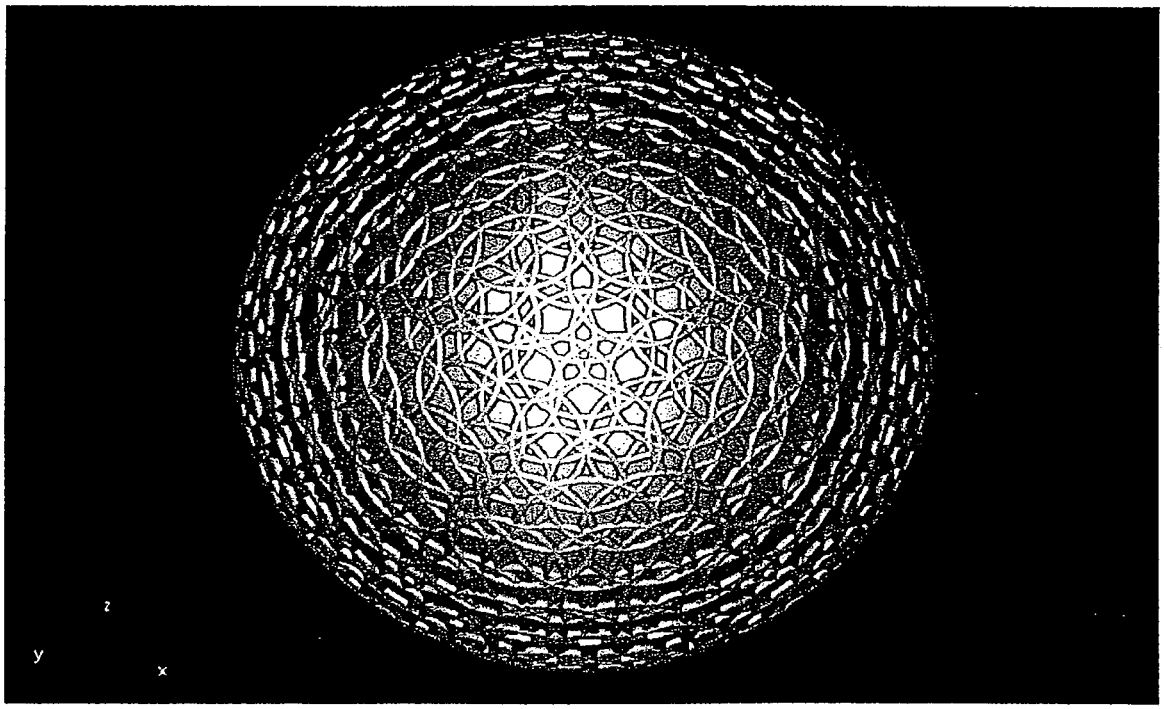
Figure 5:
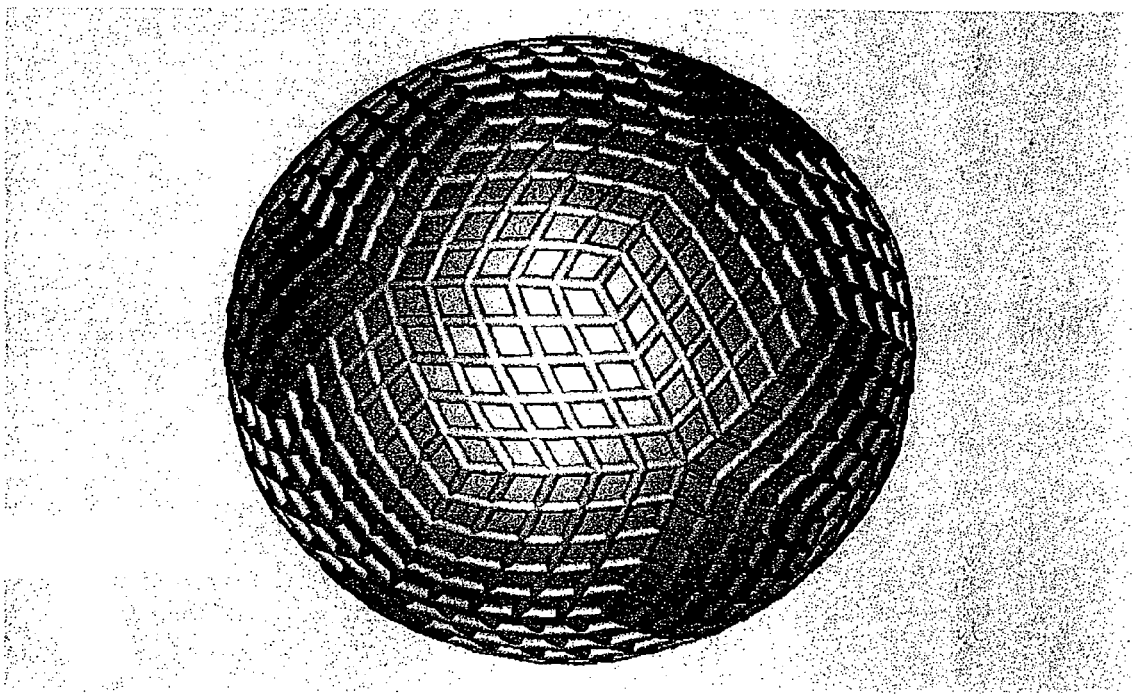
Figure 6:
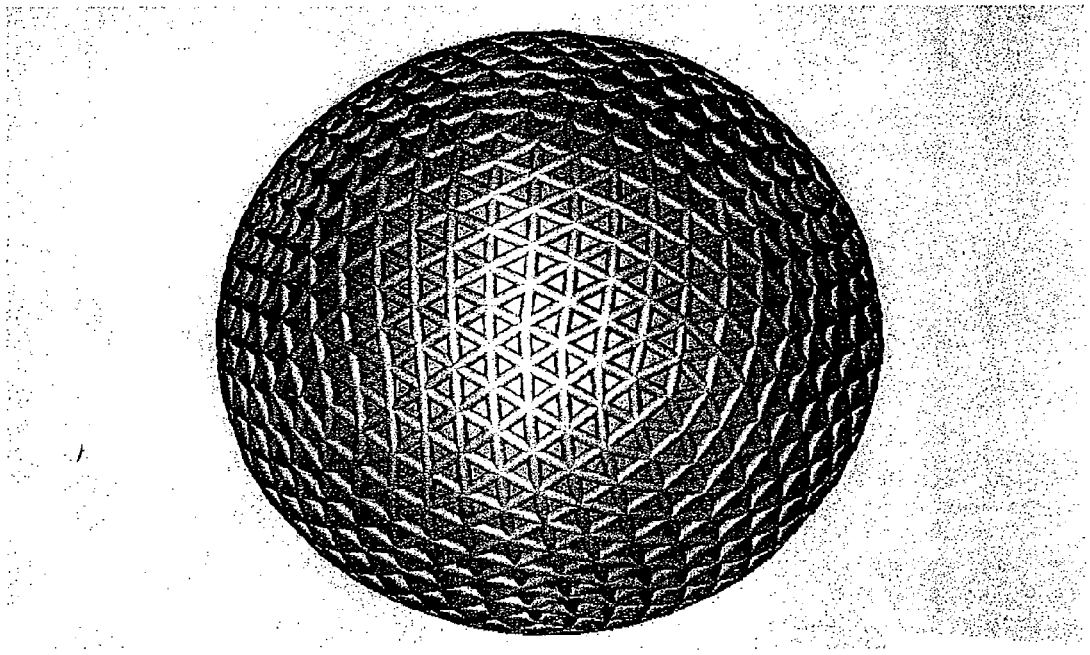
Figure 7:
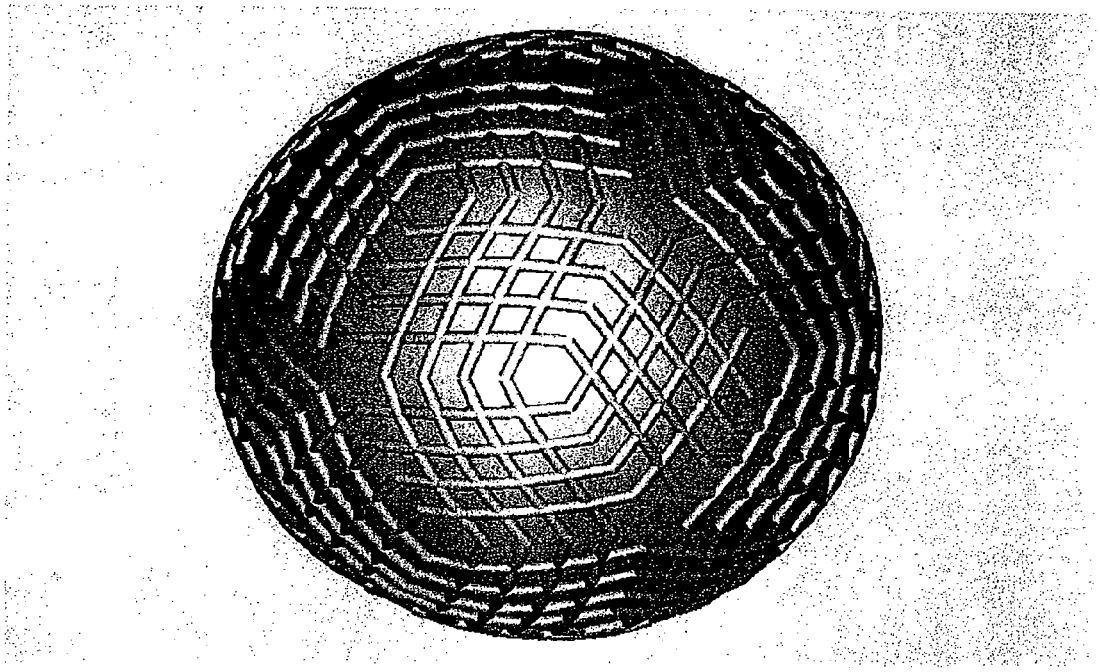
Figure 8:
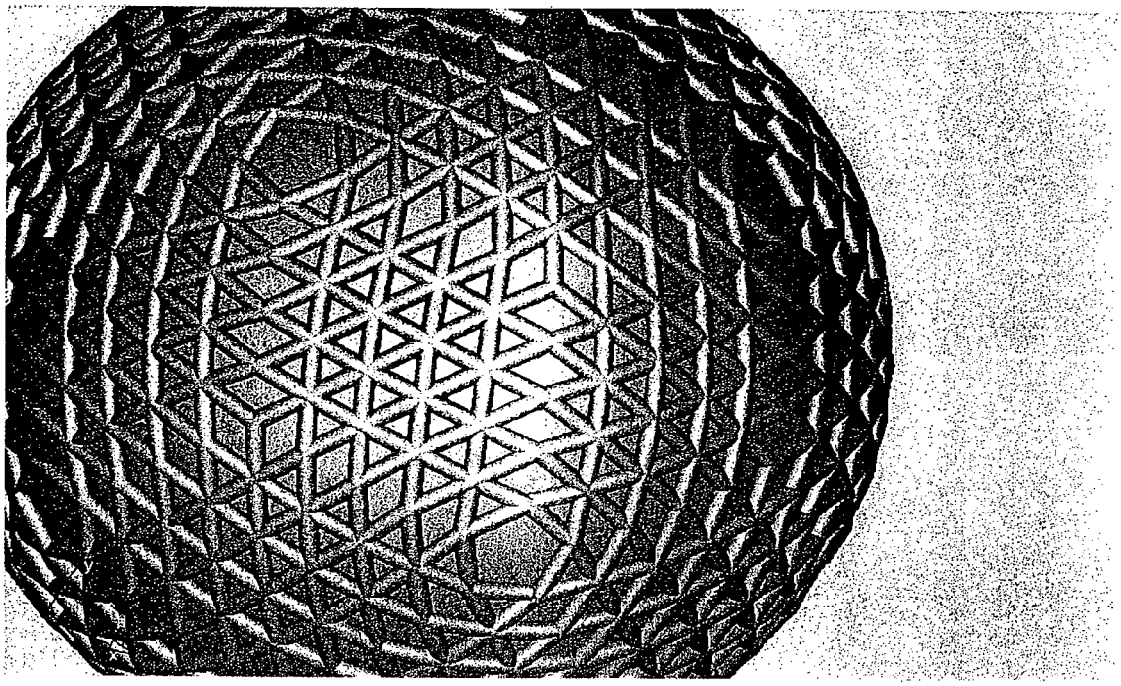
Figure 9:
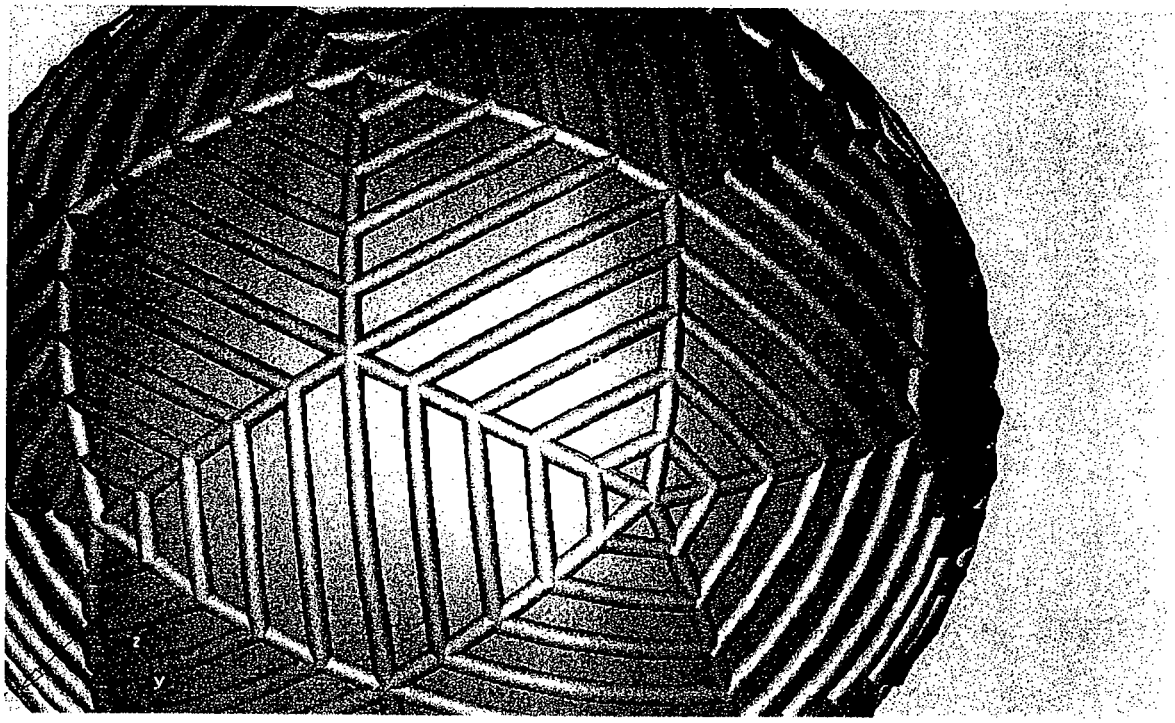
Figure 10:
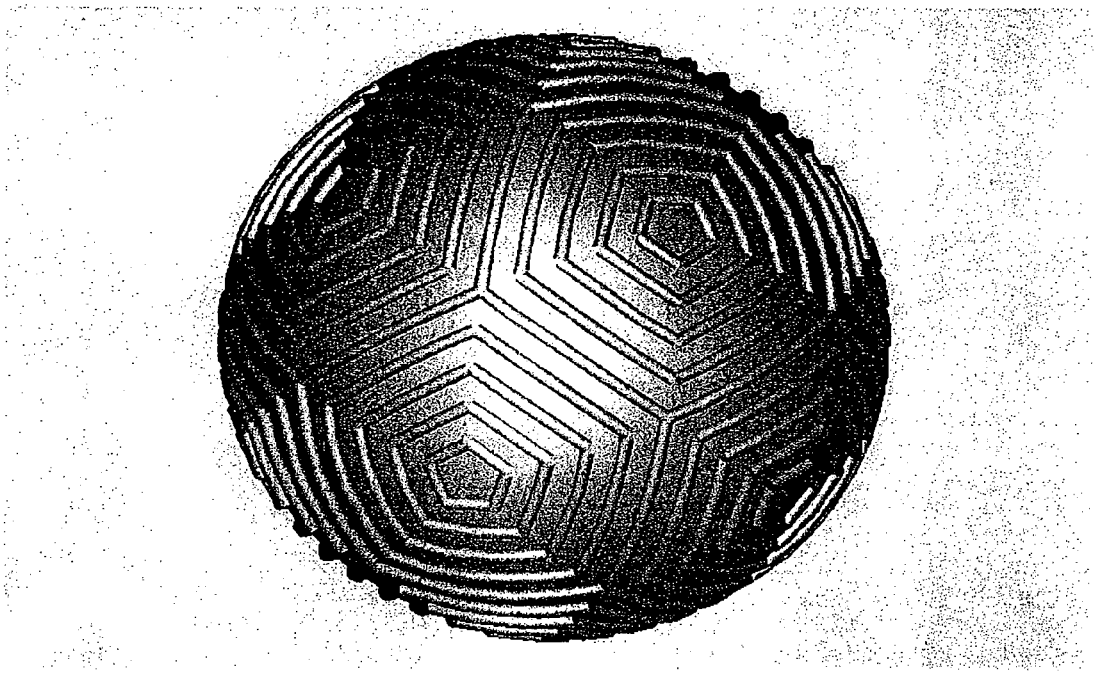
Figure 11:
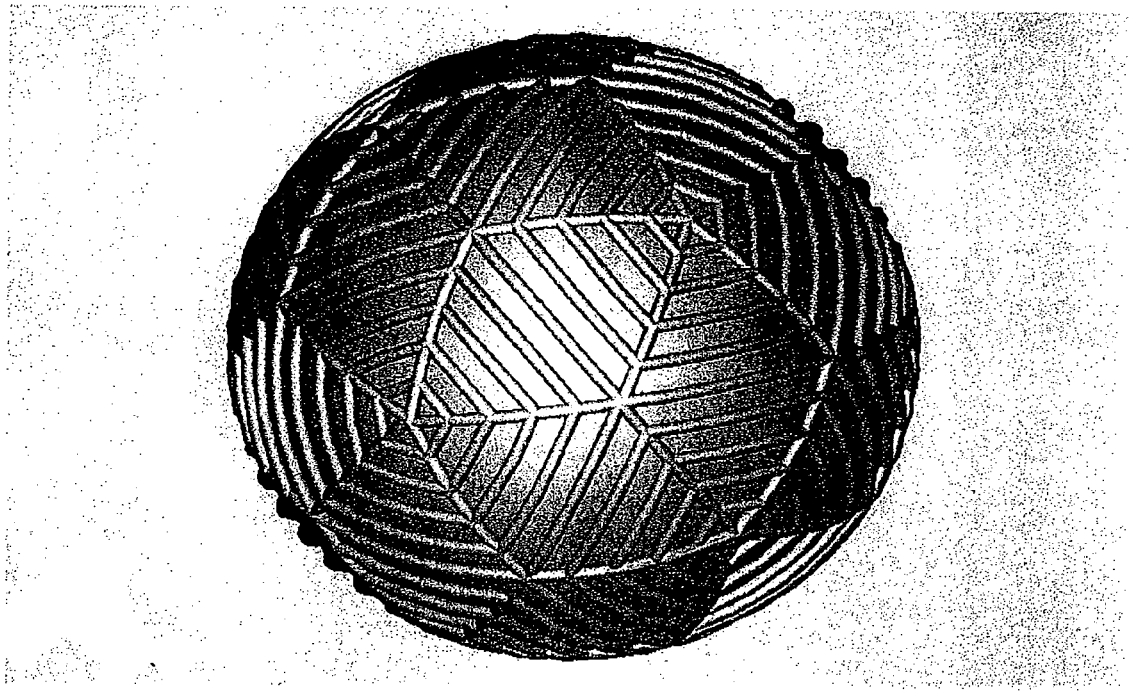
Figure 12:
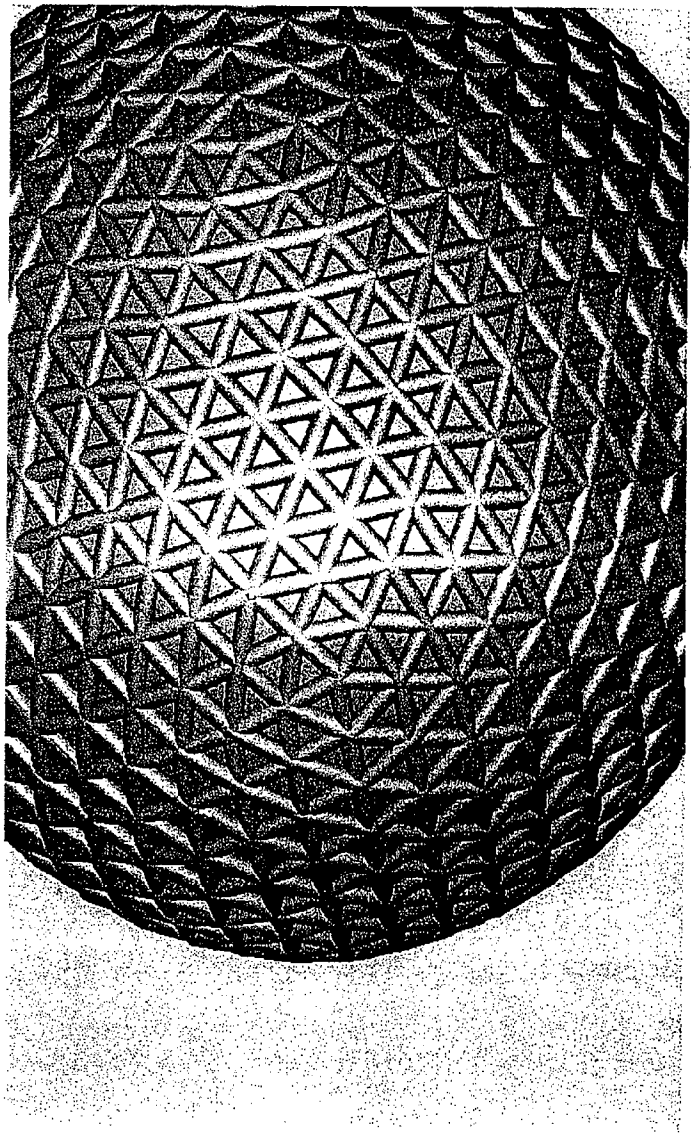
Figure 13:
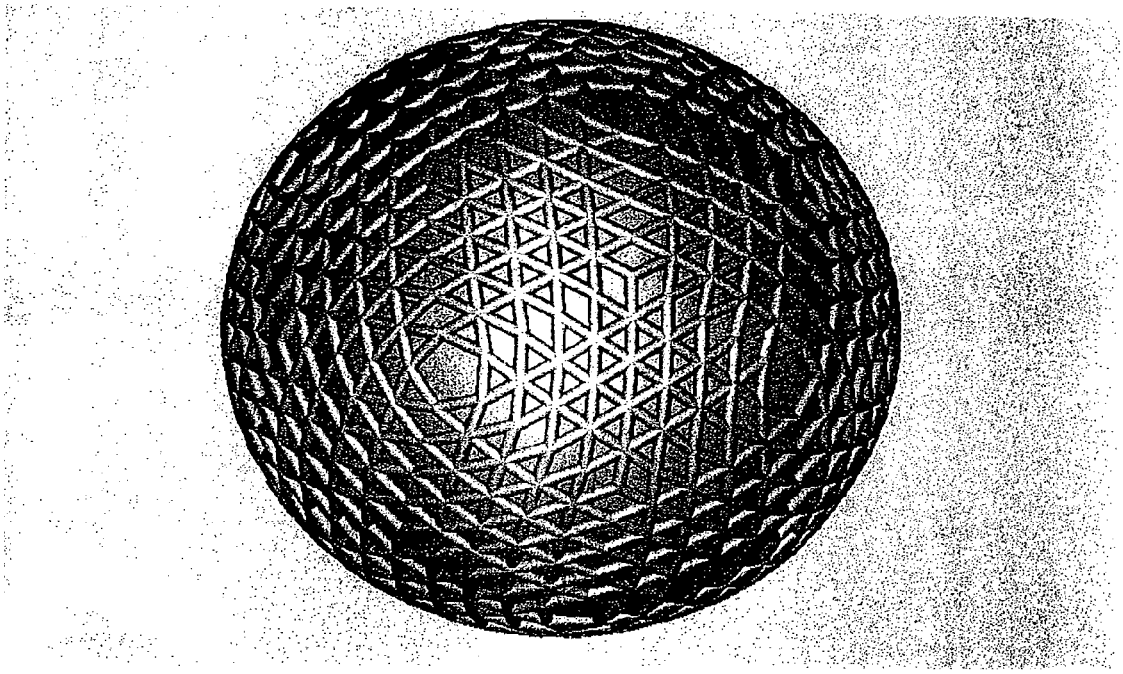
Figure 14:
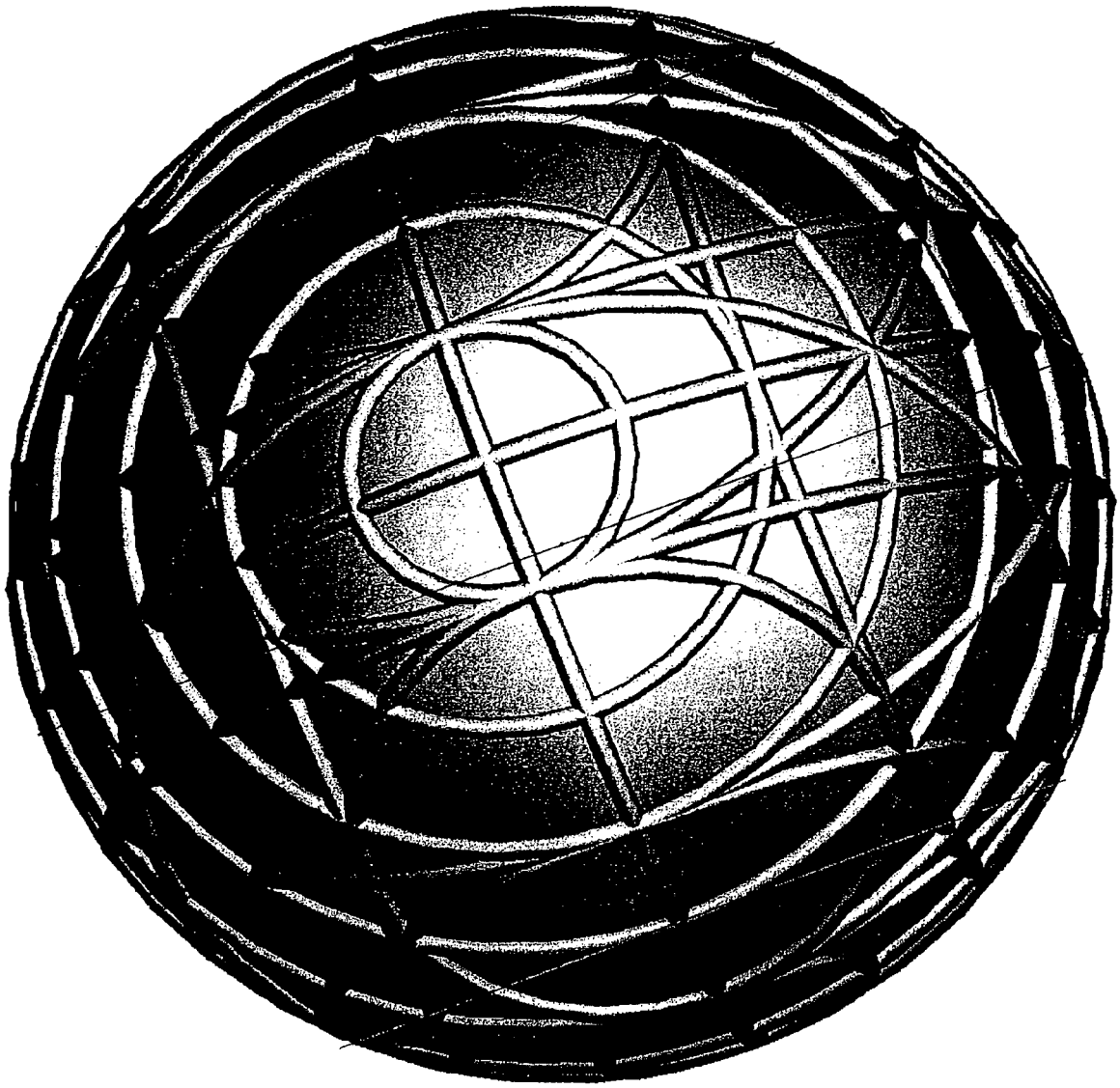

Over the years, golf ball's have evolved to include dimpled surfaces. The dimpled surfaces are typically used to reduce drag, thereby increasing the distance a golf ball is capable of flying. Although round dimples are used by most manufacturers, other shapes such as hexagonal, square, oval, and the like have been experimented with. The dimple depth, shape, and even the number of dimples have been modified in an attempt to reduce the drag on the golf ball as much as possible.

Manipulation of dimples, however, may eventually reach a point beyond which drag cannot be reduced further. Accordingly, other methods of reducing drag or increasing lift may be useful. The present invention provides a method for altering the texture of the surface of a golf ball that is capable of reducing drag on a golf ball during flight. The present invention is capable of achieving the reduction in drag by generating a golf ball surface texture based on sweeping shaped profiles across predetermined guide patterns on the ball's spherical surface. Preferably, the reduction in drag may be achieved without using conventional dimples. However, it may be desirable to include protrusions or entrenchments on the surface of the golf ball after the shaped profiles have been swept across the predetermined guide patterns.

According to one aspect of the present invention, the shaped profiles and the predetermined guide patterns may be generated using a processor based computer program or the like. It may be desirable for the processor to be capable of executing computer program instructions. In one embodiment, the processor may be operatively connected to, for example, a memory, user interface, display, and the like. Preferably, the processor is capable of running an operating system that supports a computer program that is capable of simulating the effect of dragging a plurality of different shaped profiles across different paths. It may be desirable for the processor to be capable of determining the drag that would result from different combinations of shaped profiles and guide patterns such that a golf ball manufacturer could use this calculation to choose combinations that result in optimal golf ball surfaces.

In one embodiment, the present invention comprises a method for forming a golf ball surface texture that reduces drag. Preferably, the method includes determining a guide pattern to be mapped to the spherical surface of the ball. The guide pattern may have any desired shape. This may include, but is not limited to, geometric patterns, fractal patterns, irregular patterns, lines, and the like. In one embodiment, it may be desirable for the pattern to be a combination of at least two of geometric patterns, fractal patterns, irregular patterns, and lines.

Once the guide pattern is determined, it is preferably mapped to the spherical surface of the golf ball. In one embodiment, this may be done through the use of a computer program, as described above. Preferably, the guide pattern acts as a "path definer," or the track that a shaped profile is capable of being guided along. By guiding a shaped profile along the guide pattern, a golf ball surface texture that substantially minimizes drag may be realized.

It may be desirable for the profile to comprise any desired shape. The shapes that may be used include, but are not limited to, geometric patterns, fractal patterns, irregular patterns, and the like. Preferably, the shaped profile is chosen such that sweeping the profile along the guide pattern results in a golf ball that has a substantially minimal amount of drag. According to one aspect of the present invention, protrusions or entrenchments may be added to the surface of the golf ball as desired after the shaped profile is swept along the guide pattern.

FIGS. 1-14 are diagrams showing exemplary guide patterns that may be used according to one aspect of the present invention. As shown in FIGS. 1-14, the guide patterns may comprise lines, regular shapes, irregular shapes, or combinations thereof. In one embodiment, the guide patterns are preferably randomly defined. This may be done manually or automatically through the use of a processor, computer, and the like. In some embodiments, more than one guide pattern may be used. For example, it may be desirable to map a first guide pattern to a golf ball surface. A shaped profile may then be guided along, or swept along the first guide pattern, resulting in a first surface texture. In such an embodiment, a second guide pattern may then be mapped to the surface of the golf ball. Either the same shaped profile or a different shape profile may then be swept along the second guide pattern. As the second shaped profile is swept along the surface of the golf ball, the first surface texture may be altered, resulting in a second surface texture. This may be repeated any desired number of times. One advantage of using multiple guide patterns and profiles is that a combination of two or more guide patterns and/or profiles may result in decreased drag.

In another embodiment, the guide patterns may be predictably defined. This may be accomplished, for example, by basing the guide patterns on one or more mathematical functions. One advantage of basing the shape of the guide patterns on mathematical functions is that a golf ball manufacturer can manipulate the known function in predictable ways in order to generate a profile that results in drag being substantially minimized. The one or more guide patterns based on mathematical functions may be combined with, for example, geometric patterns, fractal patterns, irregular patterns, and the like.

In one embodiment, two or more guide patterns may be combined. Preferably, the combination of the guide patterns is performed before the shaped profiles are swept across the guide patterns. Combination of the guide patterns may be performed on the randomly defined guide patterns described above or guide patterns based on one or more mathematical functions. Combination of the guide patterns may be accomplished by, for example, adding, subtracting, multiplying, or dividing two or more guide patterns. In other embodiments, other methods of combination, such as convolution and the like, may be performed on two or more guide patterns.

In one embodiment, between about 1 and about 30 mathematical functions may be used to define a guide pattern. More preferably, between about 1 and about 15 mathematical functions may be used to define a guide pattern. Most preferably, between about 1 and about 10 mathematical functions may be used to define a guide pattern. In another embodiment, about 1 or more mathematical functions are preferably used to define a guide pattern. More preferably, about 10 or more mathematical functions may be used to define a guide pattern. Most preferably, about 30 or more mathematical functions may be used to define a guide pattern.

Preferably, between about 1 and about 25 guide patterns may be used to determine the surface texture of a golf ball. More preferably, between about 1 and about 10 guide patterns may be used to determine the surface texture of a golf ball. Most preferably, between about 1 and about 5 guide patterns may be used to determine the surface texture of a golf ball. In another embodiment, more than about 5 guide patterns are preferably used to determine the surface texture of a golf ball. More preferably, more than about 10 guide patterns may be used to determine the surface texture of a golf ball. Most preferably, more than about 20 guide patterns may be used to determine the surface texture of a golf ball.

In one embodiment, the one or more guide patterns may be mapped to a desired portion of the surface of the golf ball. In an embodiment where only one guide patterns pattern is used, it may be desirable to map the guide pattern to the entire surface of the golf ball. Alternately, it may be desirable to map the guide pattern to only a portion of the surface of the golf ball. In another embodiment where two or more guide patterns are used, it may be desirable to map each guide pattern to only a portion of the surface of the golf ball. In one embodiment, each guide pattern is preferably mapped to less than about 60% of the surface of the golf ball. More preferably, each guide pattern may be mapped to less than about 50% of the surface of the golf ball. Most preferably, each guide pattern may be mapped to less than about 40% of the surface of the golf ball. However, in another embodiment each guide pattern is preferably mapped to more than about 40% of the surface of the golf ball. More preferably, each guide pattern may be mapped to more than about 60% of the surface of the golf ball. Most preferably, each guide pattern may be mapped to more than about 80% of the golf ball.

In some embodiments, two or more guide patterns may be mapped to portions of the surface of the golf ball such that a predetermined portion overlaps. In one embodiment, the amount of overlap is preferably between about 0% and about 50%. More preferably, the amount of overlap may be between about 5% and about 30%. Most preferably, the amount of overlap may be between about 10% and about 20%. In another embodiment, the amount of overlap is preferably about 40% or more. More preferably, the amount of overlap may be about 60% or more. Most preferably, the amount of overlap may be about 80% or more.

Figure 16A:
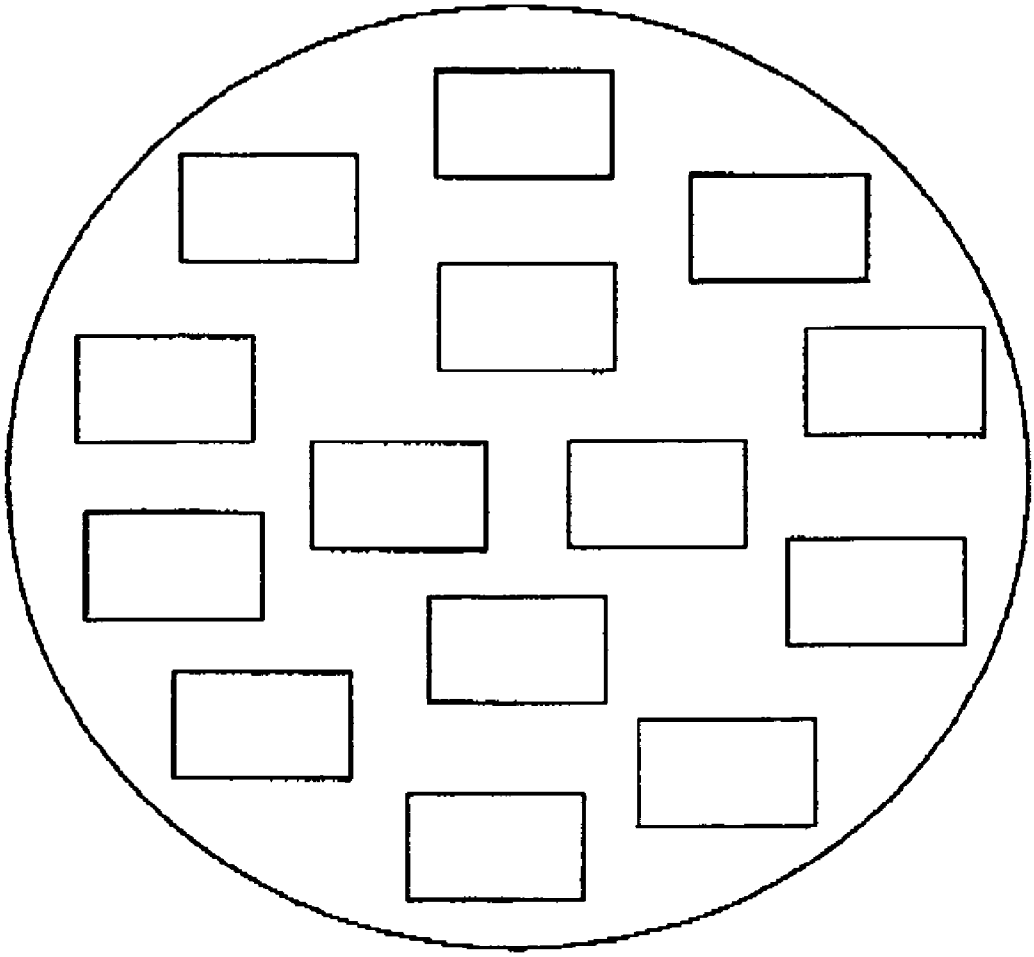
FIG. 16*a* is a diagram showing another exemplary distribution of a plurality of guide patterns according to one aspect of the present invention.
Figure 17A:
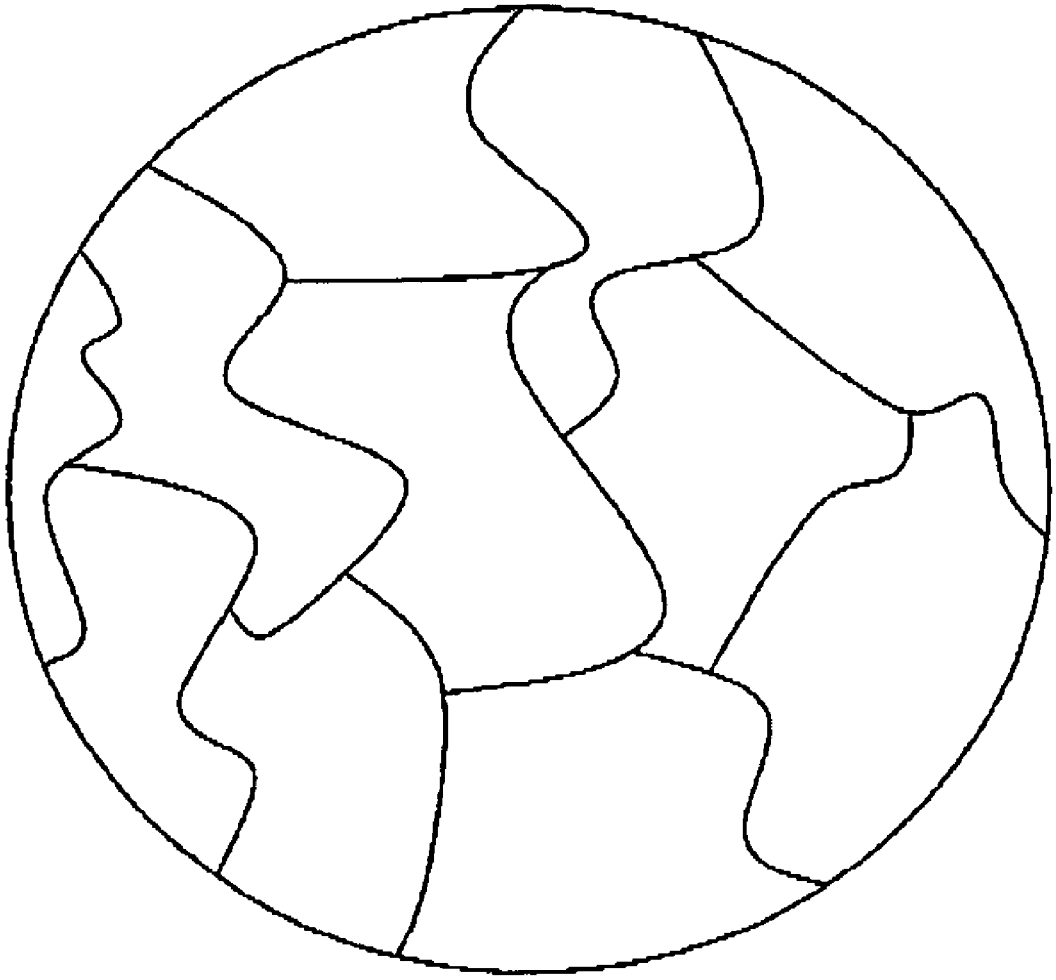
FIG. 17*a* is a diagram showing another exemplary distribution of a plurality of rude patterns according to another aspect of the present invention.

In embodiments where one or more guide patterns are not distributed over the entire surface of the golf ball, the guide patterns may be distributed in a continuous or discontinuous manner. In other words, in some embodiments, the guide pattern may be used at predetermined isolated portions of the golf ball, as shown in FIG. 16 and FIG. 16*a*. In particular, FIG. 10*a* shows the use of more than 10 guide patterns at predetermined isolated portions of the golf ball. Alternatively, the guide pattern may be used in a continuous manner by, for example, mapping one guide pattern to one half of a golf ball, and mapping another guide pattern to the other half of the golf ball, as shown in FIG. 17. FIG. 17*a* illustrates the continuous concept when more than 10 guide patterns are employed.

As mentioned above, one or more shaped profiles are preferably swept across the guide pattern once it has been determined. FIGS. 15A-15F are diagrams showing exemplary shaped profiles according to one aspect of the present invention. In FIGS. 15A-15F, the shaped profile is represented by a line 20 of varying shape, and the guide pattern is represented by dot 22 on ball surface 1. In one embodiment, the shaped profiles may comprise any desired shape. Examples of shaped profiles that may be used include, for example, spherical curves, Gaussian curve, Poisson curve, caternary curve, parabolic curves, hyperbolic curves, and the like. In one embodiment, the profile preferably comprises a smooth and continuous surface, as shown in FIGS. 15A-15F. One advantage of using a profile that includes a smooth and continuous surface is that the drag may be substantially minimized. By contrast, a profile that includes sharp edges and discontinuities would increase drag, and is therefore undesirable in many golf applications.

Figure 15A:
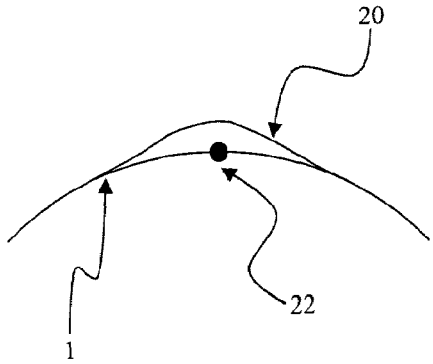
FIGS. 15A-15F are individualized cross-sectional views showing the combination of the guide pattern and exemplary sweep profiles on the surface golf ball according to one aspect of the present invention.
Figure 15B:
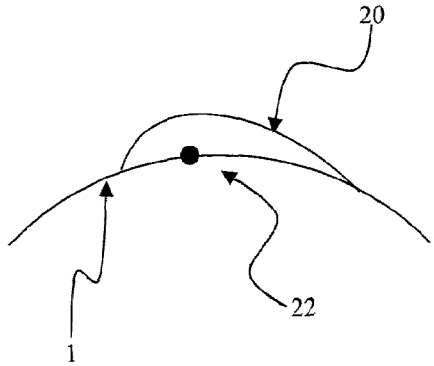
Figure 15C:
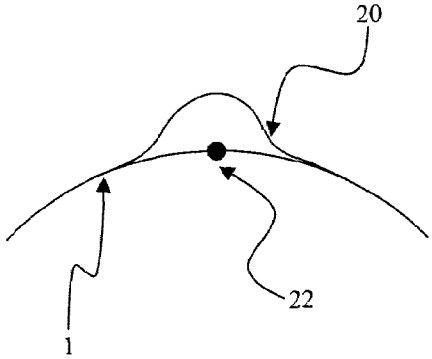
Figure 15D:
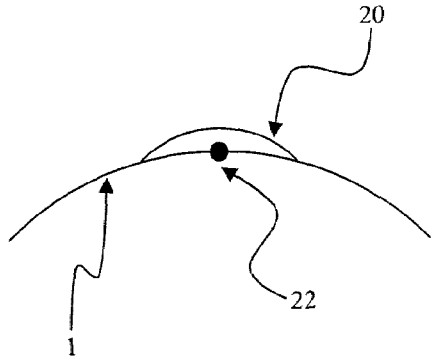
Figure 15E:
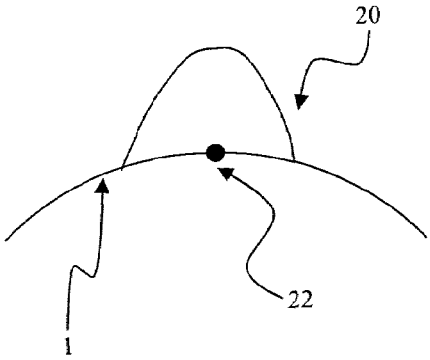
Figure 15F:
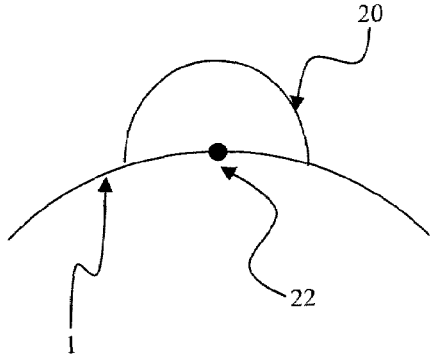

In one embodiment, it may be desirable to use shaped profiles that includes a portion that is tangent to the spherical surface of the golf ball. One embodiment of a shaped profile that includes such a tangency is shown in FIG. 15C. One advantage of using a shaped profile that includes a tangency to the surface of the golf ball is that such profiles are better able to reduce drag. In one embodiment, only a portion of the shape includes a tangency to the spherical surface of the golf ball. It may be desirable for other portions of the shape to include protrusions, entrenchments, and the like. Preferably, the shape of the profile may be determined according to the guide pattern that is mapped onto the surface of the golf ball. However, in other embodiments the shape may not be based on the one or more guide patterns that are used.

According to one aspect of the present invention, more than one shaped profile may be used with a given guide pattern. For example, in one embodiment a first shaped profile may be swept along a first guide pattern, resulting in a first surface texture. A second shaped profile may then be swept along the first guide pattern, resulting in a second surface texture. This may be repeated as many times as desired using a plurality of different shaped profiles. Alternately, more than one shaped profile may be swept along different guide patterns. For instance, a first shape profile may be swept along a first guide pattern, resulting in a first surface texture. A second shaped profile may then be swept along a second guide pattern, resulting in a second surface texture. In other embodiments, other combinations of guide patterns and profiles may be used as desired in order to reduce the drag experienced by the golf ball. For example, a single profile may be used with more than one guide pattern, more than one profile may be used with a single guide pattern, or combinations thereof may be used.

In one embodiment, a single shaped profile may be used. However, as described above, more than one shaped profile may be used in many applications. Preferably, between about 1 and about 30 shaped profiles may be used to generate the surface texture of a golf ball. More preferably, between about 1 and about 15 shaped profiles may be used to generate the surface texture of a golf ball. Most preferably, between about 1 and about 5 shaped profiles may be used to generate the surface texture of a golf ball. In another embodiment, about 1 or more profiles are preferably used to generate the surface texture of a golf ball. More preferably, about 5 or more profiles may be used to generate the surface texture of a golf ball. Most preferably, about 20 or more profiles may be used to generate the surface texture of a golf ball.

According to another aspect of the present invention, protrusions or entrenchments may be added to the surface of the golf ball after the surface texture based on the one or more shaped profiles and the one or more guide patterns has been generated. In one embodiment, the protrusions may comprise any shape, for example, irregular, regular, geometric, and the like. It may be desirable for the protrusions to be smooth and continuous, similar to the shaped profiles, in order to reduce drag. In addition, it may be desirable for the height of the protrusions to be limited to prevent unnecessary drag. The entrenchments may also comprise any shape, for example, irregular, regular, geometric, and the like. The entrenchments are preferably smooth and continuous in order to substantially minimize drag. In one embodiment, the entrenchments may comprise dimples. The dimple depth, size, and shape may be varied as desired.

Although the invention has been described with reference to particular embodiments, it will be understood to those skilled in the art that the invention is capable of a variety of alternative embodiments within the spirit of the appended claims.

The invention claimed is:

1. A method for forming a textured surface for a golf ball, comprising:

generating a guide pattern;

mapping the guide pattern to at least a portion of the surface of the golf ball;

generating a first shaped profile;

generating a first textured surface for the golf ball based on sweeping the first shaped profile along the guide pattern;

generating a second shaped profile; and generating a second textured surface for the golf ball based on sweeping the second shaped profile along the guide pattern.

2. The method according to claim 1, wherein the guide pattern comprises one of geometric patterns, fractal patterns, lines, and irregular patterns.

3. The method according to claim 1, wherein the guide pattern is randomly defined.

4. The method according to claim 1, wherein the guide pattern comprises a combination of at least two of geometric patterns, fractal patterns, lines, and irregular patterns.

5. The method according to claim 1, wherein the first and second shaped profiles comprise at least one of irregular shapes and regular shapes.

6. The method according to claim 1, wherein the first and second shaped profiles comprise a smooth and continuous curve.

7. The method according to claim 1, wherein the guide pattern is based on between about 1 and about 30 mathematical functions.

8. The method according to claim 1, wherein the step of generating a guide pattern comprises generating between about 1 and about 25 guide patterns.

9. The method according to claim 1, wherein the first and second shaped profiles comprise at least one of a spherical curve, Gaussian curve, Poisson curve, catenary curve, parabolic curve, and hyperbolic curve.

10. The method according to claim 1, wherein the first and second shaped profiles comprise a portion that is tangent to the spherical surface of the golf ball.

11. The method according to claim 1, wherein the guide pattern comprises a combination of two or more guide patterns.

12. The method according to claim 11, wherein the step of mapping comprises overlapping the at least a portion for at least two of the guide patterns by an amount of about 5 percent to about 30 percent.

13. A method for generating a textured surface for a golf ball, comprising:

generating a plurality of guide patterns, wherein the plurality of guide patterns comprises more than about 10 guide patterns;

mapping the plurality of guide patterns to at least a portion of the surface of the golf ball;

generating a plurality of shaped profiles; and determining a textured surface for the golf ball based on sweeping at least one of the plurality of shaped profiles along the plurality of guide patterns.

14. The method according to claim 13, wherein each of the plurality of guide patterns is mapped to more than about 60 percent of the surface of the golf ball.

15. The method according to claim 14, wherein each of the plurality of guide patterns is mapped to less than about 60% of the surface of the golf ball.

16. The method according to claim 13, wherein two or more of the plurality of guide patterns may overlap by a predetermined amount.

17. The method according to claim 16, wherein the amount of overlap is between about 4% to about 30%.

18. The method according to claim 13, wherein two or more of the plurality of shaped profiles are guided along one of the plurality of guide patterns.

19. The method according to claim 13, wherein one of the plurality of shaped profiles is swept along two or more of the plurality of guide patterns.

20. A method for generating a textured surface for a golf ball, comprising:

generating a plurality of guide patterns based on at least one of geometric patterns, fractal patterns, lines, and irregular patterns;

mapping each guide pattern to a portion of the surface of the golf ball;

generating a plurality of shaped profiles comprising at least one of a spherical curve Gaussian curve, Poisson curve, catenary curve, parabolic curve, or hyperbolic curve; and determining a textured surface for the golf ball based on sweeping at least one of the plurality of shaped profiles along each guide pattern.

* * * * *